United States Patent [19]

Heim

[11] 3,953,922

[45] May 4, 1976

[54] METHOD OF ELIMINATING THE TRAINING EFFECT IN SUPERCONDUCTING COILS BY POST-WIND PRELOAD

[75] Inventor: Joseph R. Heim, Aurora, Ill.

[73] Assignee: The United States of America as represented by the United States Energy Research and Development Administration, Washington, D.C.

[22] Filed: Feb. 24, 1975

[21] Appl. No.: 552,525

[52] U.S. Cl. ..... 29/602 R; 148/125; 148/133; 29/421 R; 72/56

[51] Int. Cl.[2] ..... H01F 7/06

[58] Field of Search ..... 29/599, 602, 605, 607, 29/421; 335/216; 336/DIG. 1; 148/11.5 R, 125, 131; 72/56, 54

[56] References Cited

UNITED STATES PATENTS

| | | | |
|---|---|---|---|
| 3,023,495 | 3/1962 | Noland | 29/421 |
| 3,764,401 | 10/1973 | Hrusovsky | 148/125 X |
| 3,859,566 | 1/1975 | Gassong et al. | 335/216 X |

*Primary Examiner*—Milton S. Mehr
*Attorney, Agent, or Firm*—Dean E. Carlson; Arthur A. Churm; Donald P. Reynolds

[57] ABSTRACT

The training effect in superconducting coils is eliminated by winding the coil with a composite material that includes both a superconductor and a normal material and then applying stresses to the wound coil in the direction that electromagnetic stresses will be applied to the coil during normal use and in a magnitude greater than the calculated magnitude of the greatest electromagnetic stresses to be applied to the coil.

6 Claims, 6 Drawing Figures

METHOD OF ELIMINATING THE TRAINING EFFECT IN SUPERCONDUCTING COILS BY POST-WIND PRELOAD

CONTRACTUAL ORIGIN OF THE INVENTION

The invention described herein was made in the course of, or under, a contract with the UNITED STATES ATOMIC ENERGY COMMISSION.

BACKGROUND OF THE INVENTION

This invention relates to the field of superconductivity. It is a method of construction by which the training effect is eliminated from coils formed of a composite material including both superconducting and normal materials.

The use of superconducting materials for current-carrying coils to generate large magnetic fields offers many theoretical advantages. In particular, the possibility of achieving much higher current densities than are possible in normal materials and the possibility of reducing lost electrical energy both tend to make the superconducting coil an attractive option where large magnetic fields are desired. It is, however, normally necessary to protect superconducting materials against destruction by thermal runaway if the superconductor goes normal by embedding the superconducting material in the form of filaments in a matrix of a material that exhibits higher electrical conductivity in the normal state than do superconducting materials. Copper is the most commonly used material for such a conducting matrix. Aluminum and alloys of copper and nickel have also been used. The matrix provides a protective shunt in the event that the superconducting material becomes normal for any reason. However, a phenomenon known as the training effect interferes with the ready use of composite materials. The training effect is observed in composite superconducting coils as a reversion to the normal state at a value of current far below the design maximum value when current is first applied to the coil. As the current in the coil is cycled between zero or a small value and a large value, the upper limit of coil current is observed to increase continually. It is as though the coil were being trained to carry an increasingly large value of current; thus, the name "training effect". The result is a theoretically unsatisfying, expensive, and potentially dangerous situation in which a superconducting coil must be repeatedly quenched to the normal condition to train it to carry higher values of current. This is time-consuming and risks damage to the coil during the training process.

Compounding this problem is the fact that most superconducting coils are operated in liquid helium at temperatures near 4°K. In order to maintain the superconducting state of all the superconducting material throughout the matrix, it is necessary to assure that no temperature gradient in the matrix causes a local region in which the temperature exceeds the critical temperature of the superconductor. There are two basic ways to keep down temperature gradients in the matrix material. One is to minimize distances between portions of the matrix material and liquid helium by means such as passing cooling channels through the matrix material. This has the disadvantage of reducing the net current density if the total cross-sectional area of material including the area of the cooling ducts is considered as a necessary portion of the cross-sectional area of the coil. This is obviously a situation that is preferably avoided where one is attempting to construct a coil for placement in a limited volume. When this is a consideration, it has been common to use metallic fins of high conductivity as heat drains sandwiched between layers of the composite material to provide better conduction to the liquid helium bath of heat generated in the matrix. The other way to minimize temperature gradients is to use potting compounds that are selected for good heat conductivity.

The training effect is believed to result from a non-uniform residual stress distribution over the cross section of the composite material. The cross-sectional stress distribution is distorted by bending of the superconducting composite material during manufacturing, spooling for transport and forming of the wire into a coil. Test observations are consistent with this hypothesis in that the material exhibits inelastic behavior when subjected to tensile stresses.

It is an object of the present invention to provide a method of construction of composite superconducting coils that minimizes the training effect.

It is a further object of the present invention to provide a method of constructing superconducting coils that causes the generation of a minimum amount of heat in the coils during normal operation.

It is a further object of the present invention to provide a method of construction of superconducting coils that allows the coils to carry the theoretical maximum design current.

Other objects will become apparent in the course of a detailed description of the invention.

SUMMARY OF THE INVENTION

The training effect in a composite superconducting coil is minimized by applying stresses to the wound coil in the direction of and in a magnitude greater than that of the electromagnetic forces that will be experienced by the coil during normal operation.

DESCRIPTION OF THE PREFERRED EMBODIMENT

Figure 1:
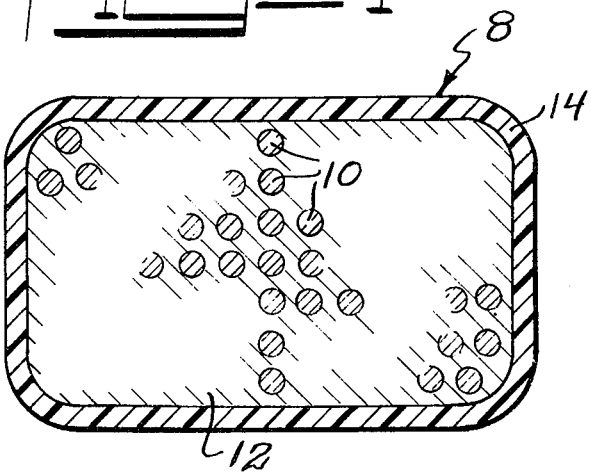
FIG. 1 is a cross section of a typical matrix superconducting coil element.

The present invention is a method of treating coils of matrix superconducting material to minimize or eliminate the training effect that is frequently observed when such coils are first used. FIG. 1 is a cross-sectional view of a typical strand 8 of such a matrix superconducting material. FIG. 1 shows a number of filaments 10 of a superconducting material such as niobium titanium, embedded in a matrix 12 of a conducting material such as copper or aluminum. The strand 8 is covered with insulation 14 so that, when a coil is wound using the structure of FIG. 1, adjacent turns are not shorted by electrical contact of matrix 12 from turn to turn. The usual method of winding a superconducting coil using the material of FIG. 1 is to cast a number of rods of superconducting material into a billet of the conducting material that forms matrix 12. The combination thus formed is swaged, rolled, and drawn to reduce the cross-sectional area to a desired value and lengthen the billet into a wire. A process of annealing may be applied at one or more times during the forming operation. It is normally applied as the last step after the insulation 14 has been applied and the composite superconductor has been wound on a spool for delivery. Alternatively, the annealing process may be the last step performed before the insulation is applied and the wire is wound on a spool for shipment. In either event, the composite material that is supplied in the cross section shown in FIG. 1 for winding into a superconducting coil is generally annealed to show little, if any, work hardening. Matrix 12 thus comprises a conducting material such as copper or aluminum or an alloy of copper and nickel that is sufficiently thoroughly annealed to have a relatively low range of applied stresses over which its behavior can be described as elastic. The condition of annealing of matrix 12 is not substantially affected by the small amount of work hardening resulting from winding the coil. However, matrix 12 will be under internal stress as a result of bending, with those portions of the cross section close to the smaller radius stressed in compression and those close to the larger radius being in tension. It is believed that the continuing reduction of these stresses by slippage at grain boundaries is the cause of training in such coils and it is the object of the present invention to minimize or eliminate this cause.

Figure 2:
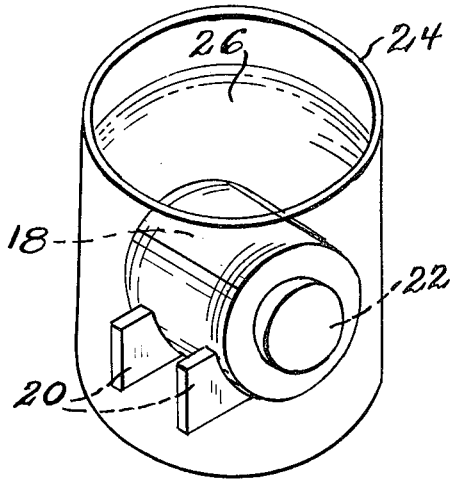
FIG. 2 is a view of a typical superconducting coil undergoing post-wind preload in a cryogenic bath.

FIG. 2 is a view of a coil undergoing a post-wind preload to effect a proper change in the internal stress distribution in each cross section of the composite superconducting material of which the coil is wound. In FIG. 2, coil 18 is a typical superconducting coil wound of a composite material having a cross section similar to that shown in FIG. 1. Such a coil typically is formed of two or more layers of the composite material, each layer having a number of turns. Adjacent and overlying turns are insulated from one another by insulation 14 of FIG. 1. The present invention is practiced by placing the coil 18 on supports 20 and by inserting a mandrel 22 in the coil. Mandrel 22 is sized to effect a close fit inside coil 18 and is selected of a material having a thermal coefficient of cubical expansion that is less than that of the conducting material used in coil 18. An example of such a material is an iron alloy containing 36% nickel that is sold under the trademark Invar. Coil 18 is placed on supports 20 in bath 24 and is cooled by immersion in liquid nitrogen 26. Both coil 18 and mandrel 22 contract but, because of the selection of the materials in coil 18 and mandrel 22, coil 18 contracts more than mandrel 22. The result is to exert a force radially outward on coil 18. This force is calculated using the Lamé equations (see, e.g., Seeley and Smith, *Advanced Mechanics of Materials*, 2d Ed., 1966, at page 296) to be greater than the electromagnetic force exerted on coil 18 under conditions when coil 18 is carrying its design current. The result is to leave the conducting material in coil 18 in a state of internal stress such that application of the design current to coil 18 in normal operation causes the conducting material in coil 18 to be at a point in the stress-strain curve of this material which is within the proportional elastic limit of the material. Accordingly, there is no tendency for the material of coil 18 to undergo plastic deformation or slippage at grain boundaries and there is therefore no frictional conversion of internal strain energy into heat to affect the superconducting state of the superconducting material in coil 18. As a result, when coil 18 is removed from bath 24 and mandrel 22 is removed from coil 18, it can be seen that coil 18 needs little or no training to achieve a proper state of internal stress. The process of inserting mandrel 22 and cooling coil 18 has accomplished a post-wind preload of coil 18.

Figure 3:
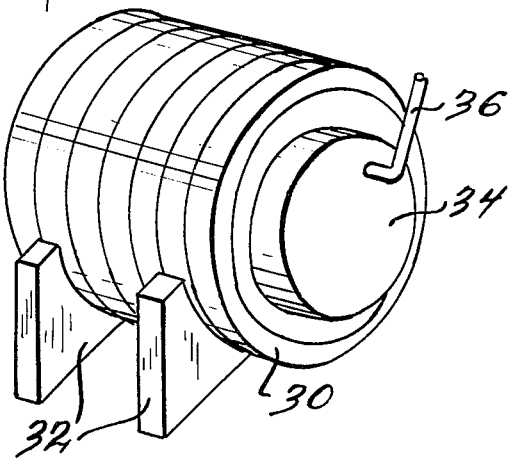
FIG. 3 is a view of a typical superconducting coil undergoing post-wind preload by pressure means.

FIG. 3 shows a method of accomplishing a post-wind preload by pressure. In FIG. 3, coil 30 is a composite superconducting coil comprising filaments of a superconducting material embedded in a conducting material. Supports 32 hold coil 30 while internal collet 34 is used to accomplish a post-wind preload of coil 30. The preload is accomplished through pressure-applying and venting means 36 which conducts a fluid under pressure into internal collet 34. The internal pressure is transmitted equally to preload coil 30 from inside and thus to preload the conducting material therein in tension to the point that the internal stresses, when coil 30 is later connected to carry its design current, will place the conducting material of coil 30 within the elastic range of the conducting material of coil 30. By this means, the need for training is minimized or eliminated.

Figure 4:
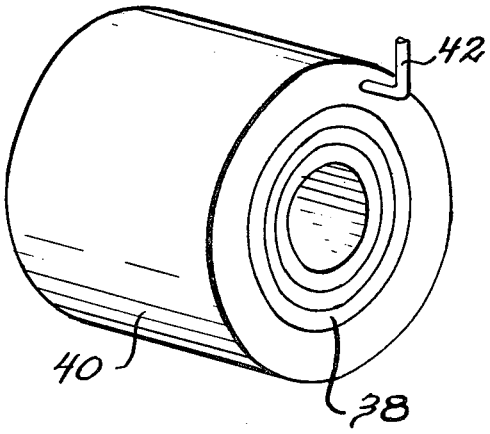
FIG. 4 is a view showing an alternate means of applying post-wind preload by pressure.

FIG. 4 is a drawing of an alternate means of applying preload by pressure. In FIG. 4, composite superconducting coil 38 is disposed coaxially within an annular cylinder 40 that is sized to have a close fit with coil 38 when annular cylinder 40 is not pressurized. Application of fluid pressure to annular cylinder 40 through pressure applying and venting means 42 will squeeze coil 38 from outside, applying a force in compression. The applied force is calculated to be great enough to place the matrix material of coil 38 in its elastic range when carrying its rated current. By this means, post-wind preload is accomplished in compression.

Figure 5:
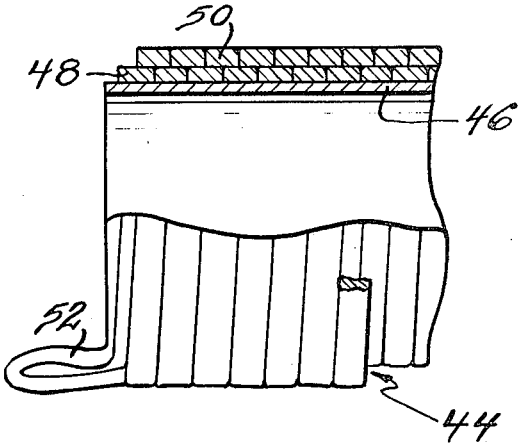
FIG. 5 is a partial sectional view of a typical multilayer superconducting coil.
Figure 6:
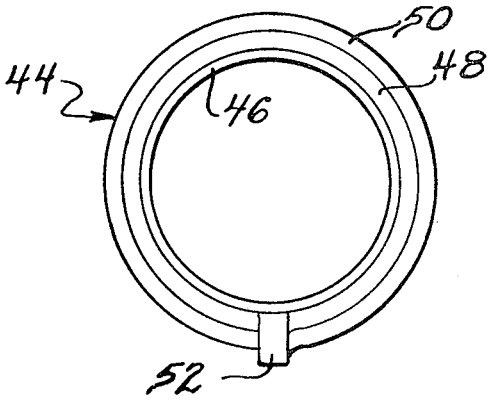
FIG. 6 is an end view of the coil of FIG. 5.

One remaining area of concern is the part of the composite superconducting coil that effects a transition from one layer to another. This is shown in FIGS. 5 and 6, which are respectively a partial sectional side view and an end view of a typical composite superconducting coil. In FIGS. 5 and 6, composite superconducting coil 44 includes a cylindrical support structure 46 providing a framework of a composite superconducting material, supporting first layer 48, which in turn supports second layer 50 of composite superconducting material. Connecting strip 52 makes an electrical connection between first layer 48 and second layer 50. Post-wind preload according to one of the methods described earlier will apply a force to alter the state of stress of one of the layers 48 or 50. This force will be coupled by the physical contact between the two layers to preload the other layer. Only the connecting strip 52 will not be preloaded. This, however, will not prevent reduction or elimination of the training effect, since the connecting strip 52 is at an edge of layers 48 and 50 so that it comes in contact with the liquid helium used to keep the composite superconducting material in its superconducting range. Furthermore, the connecting strip 52 is free to move in response to electrical forces, and thus will not have its state of internal strain altered by the application of current to coil 44. The result is that first layer 48 and second layer 50 are preloaded to a proper state of stress as described herein, and connecting strip 52 is cooled sufficiently by exposure to liquid helium to prevent its contributing to a training effect.

An alternative way of describing the effect of post-wind preloading is to associate it with the state of stress of the material. This state is defined in terms of the yield strength of the material, usually defined as the stress necessary to produce an unloaded permanent strain of 0.2%. This stress is greater than the amount necessary to take the material to its proportional elastic limit, which is the beginning of departure of a stress-strain curve from the straight line of Hooke's Law. This departure typically begins at values of per cent strain of the order of 0.07–0.08%. Application of stresses below the proportional elastic limit results in substantially no internal displacement of molecules of the material. Above this point, higher stresses cause slippage of molecules and the consequent release of energy. This release appears as localized heating that is believed to cause the training effect. It is believed that the processes associated with winding a coil of a composite superconductor leave the matrix material in a condition of stress so that the electromagnetic forces resulting from application of a current take the composite material beyond its proportional elastic limit in some places, causing the localized heating described above. Annealing does not solve this problem and eliminate the training effect because, while annealing relieves stresses to a degree, it also reduces the proportional elastic limit. Post-wind preload simultaneously preserves the pre-existing state of anneal of the matrix material and also adjusts its state of internal stress to keep the matrix material below its proportional elastic limit in operation. This is done by stressing the material to a value in the range of 0.2 to 0.4% strain.

The embodiments of the invention in which an exclusive property or privilege is claimed are defined as follows:

1. A method of conditioning a wound superconducting coil formed of a plurality of filaments of superconducting material in a matrix of normal conducting material comprising the step of:

stressing the coil in the directions of the electromagnetic forces generated in normal use and in a magnitude greater than the magnitude of the maximum electromagnetic force generated in normal use.

2. The method of claim 1 wherein the step of stressing the coil comprises:

inserting an expandable collet into the coil;

expanding the expandable collet against the coil to strain the normal conducting material to a value of strain between 0.2% and 0.4%; and removing the expandable collet.

3. The method of claim 1 wherein the step of stressing the coil comprises:

emplacing the coil in a coaxial annular cylinder;

applying fluid pressure to the coaxial annular cylinder to compress the normal conducting material of the coil to a value of strain between 0.2% and 0.4%

4. A method of preloading a wound superconducting solenoidal coil formed of a plurality of filaments of superconducting material in a matrix of normal conducting material comprising the steps of:

placing a cylindrical mandrel coaxially within said coil, said cylindrical mandrel sized to make a close fit to said coil, said cylindrical mandrel of a material having a thermal coefficient of cubical expansion that is less than the thermal coefficient of cubical expansion of said normal conducting material; and cooling said coil containing said mandrel to cryogenic temperatures, whereby said coil is preloaded.

5. The method of claim 4 wherein said mandrel is made of Invar.

6. The method of claim 5 wherein said step of cooling said coil comprises immersing said coil containing said mandrel in liquid nitrogen.

* * * * *